US005263209A

United States Patent [19]

Pattee

[11] Patent Number: 5,263,209

[45] Date of Patent: Nov. 23, 1993

[54] NIGHT LIGHT FOR A TOILET

[76] Inventor: Brooke B. Pattee, 22821 Rumble Dr., Lake Forest, Calif. 92630

[21] Appl. No.: 9,837

[22] Filed: Jan. 27, 1993

[51] Int. Cl.[5] ..... A47K 17/00

[52] U.S. Cl. ..... 4/661; 362/101; 362/155; 362/234

[58] Field of Search ..... 4/420, 661; 362/101, 362/155, 234

[56] References Cited

U.S. PATENT DOCUMENTS

| | | | |
|---|---|---|---|
| D. 263,629 | 3/1982 | Collins et al. | D26/5 |
| 2,458,019 | 1/1949 | Niles | 4/233 |
| 2,460,543 | 2/1949 | Spierer | 4/233 |
| 2,947,850 | 8/1960 | Reilly | 4/661 X |
| 3,982,288 | 9/1976 | Borne | 4/237 |
| 4,413,364 | 11/1983 | Bittaker et al. | 4/661 |
| 4,803,604 | 2/1989 | Nichols et al. | 362/234 X |
| 4,860,178 | 8/1989 | Picon | 362/101 |
| 5,003,648 | 4/1991 | Anderson | 4/661 |
| 5,036,443 | 7/1991 | Humble et al. | 362/183 |
| 5,123,130 | 6/1992 | Sanders | 4/661 |
| 5,150,962 | 9/1992 | Rauschenberger | 362/101 |

*Primary Examiner*—Henry J. Recla
*Assistant Examiner*—Robert M. Fetsuga

[57] ABSTRACT

A night light for a toilet is disclosed. A flexible, moisture impermeable, transparent tube is positioned under an upper rim of the toilet bowl and extends therearound. A plurality of spaced apart electrical lamps lay within the tube and are wired with a switch and a power source for receiving electrical power. Double-sided adhesive tape is included for mounting the power source on the external surface of the toilet. A plurality of holding clips are positioned in spaced relationship around the toilet rim for removably holding the tube in position under the upper rim of the toilet. The switch is position sensitive and may be fixed to the toilet seat, the seat being capable of assuming a horizontal or a vertical orientation. A first latching switch and a second latching switch are included, each of which may energize the lamps by either lifting the toilet seat into a vertical position or by lowering the hinged member into a horizontal position, respectively. A delay circuit deenergizes the lamps by breaking the circuit after a pre-set delay time.

6 Claims, 2 Drawing Sheets

NIGHT LIGHT FOR A TOILET

FIELD OF THE INVENTION

This invention relates generally to night lights, and, more particularly, is directed towards a night light for a toilet.

BACKGROUND OF THE INVENTION

To one whose eyes are dark-adapted, switching on a bathroom light can be a painful, temporarily blinding experience that can last several minutes. However, conventional low-wattage night-lights typically do not provide enough light for someone who needs to use the bathroom. People whose eyes are dark-adapted, therefore are usually faced with the unpleasant choice of using the bathroom with either too little light or with too much light.

Several prior-art devices exist for illuminating a toilet and the surrounding area. For example, U.S. Pat. No. 4,860,178 to Picon on Aug. 22, 1989 teaches a battery-powered light attached to a toilet seat that is activated by lifting the seat into a vertical position or by manual switching. Such a device allows one to determine, at a glance, if the toilet seat is down or up. However, the lamp of such a device is a direct source of light when the seat is in the vertical position and, as such, is still difficult to look at with dark-adapted eyes. Further, such a device is mounted in a substantially permanent manner on the toilet seat, making the device difficult to clean as is often required. Further, the battery of such devices will quickly be drained if the seat is left in its vertical position inadvertently, or if the switch is accidentally left on, for an extended period of time.

Many of the same drawbacks exit for the device taught in U.S. Pat. No. 5,036,433 to Humble et al., issued on Jul. 30, 1991. Such a device automatically switches on when a light sensor detects darkness. However, such a light is not used continually during darkness, and hence much of the energy in its battery is wasted. While the device is adapted to be recharged by sunlight during the day, not all bathrooms have sufficient light during the day to fully recharge its batteries. Further, as with the previously mentioned patent, this type of device is difficult to remove once installed and therefore difficult to clean. Moreover, this device also presents a direct source of light to the eyes, and is difficult to look at or near with dark-adapted eyes.

Another prior-art device, taught in U.S. Pat. No. 3,982,288 to Borne on Sep. 28, 1976, shows a night light toilet seat wherein a light-conducting member is embedded within a semi-transparent or transparent toilet seat. Clearly, such a device is quite expensive to manufacture and requires replacement of otherwise conventional toilet parts. Further, while much of the light produced by such a device is indirect and therefore much easier to view with dark-adapted eyes, the light goes out when the toilet seat is raised. Men standing before a toilet need the toilet illuminated so as not to miss the toilet, and this is one of the primary reasons for having a light on a toilet in the first place.

Clearly, then, there is a need for a toilet night light that is easy to install, easy to use, and easy to clean. Such a needed device would illuminate the toilet bowl evenly and indirectly, presenting no point-sources of direct light to the user. Such a needed device would switch on simply by moving the toilet seat from one position to another, and would require no additional manually-actuated switches. Further, such a needed device would have at least one time delay means whereby the light would automatically switch off after a selectable pre-set time. The present invention fulfills these needs and provides further related advantages.

SUMMARY OF THE INVENTION

The present invention is a night light for a toilet. A flexible, moisture impermeable, transparent tube is positioned under an upper rim of the toilet bowl and extended around the toilet bowl. A plurality of spaced apart electrical lamps are wired for receiving electrical power and lay within the tube. A power source includes a connecting means for connecting the power source to the lamps. A mounting means, such as double-sided adhesive tape, is included for mounting the power source on the external surface of the toilet. A plurality of holding means are positioned in spaced relationship around the toilet rim for removably holding the tube in position under the upper rim of the toilet. A switch is wired as part of a circuit formed by the switch, the lamps, and the power source. The switch is position sensitive and may be fixed to a hinged member of the toilet that is capable of assuming a horizontal and a vertical orientation. A first energizing means and a second energizing means are included, each of which may energize the lamps by either lifting the hinged member into a vertical position or by lowering the hinged member into a horizontal position, respectively. A delayed deenergizing means deenergizes the lamps by breaking the circuit after a pre-set delay time. As such, to switch on the lamps for the pre-set delay time, one simply changes the position of the hinged member.

The present invention is a toilet night light that is easy to install, easy to use, and easy to clean. The present device illuminates the toilet bowl evenly and indirectly, and presents no point-sources of direct light to the user. The device may be switched on simply by moving the toilet seat from one position to another, and requires no additional manually-actuated switches. Further, the present invention has at least one time delay means whereby the light automatically switches off after a selectable pre-set time. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
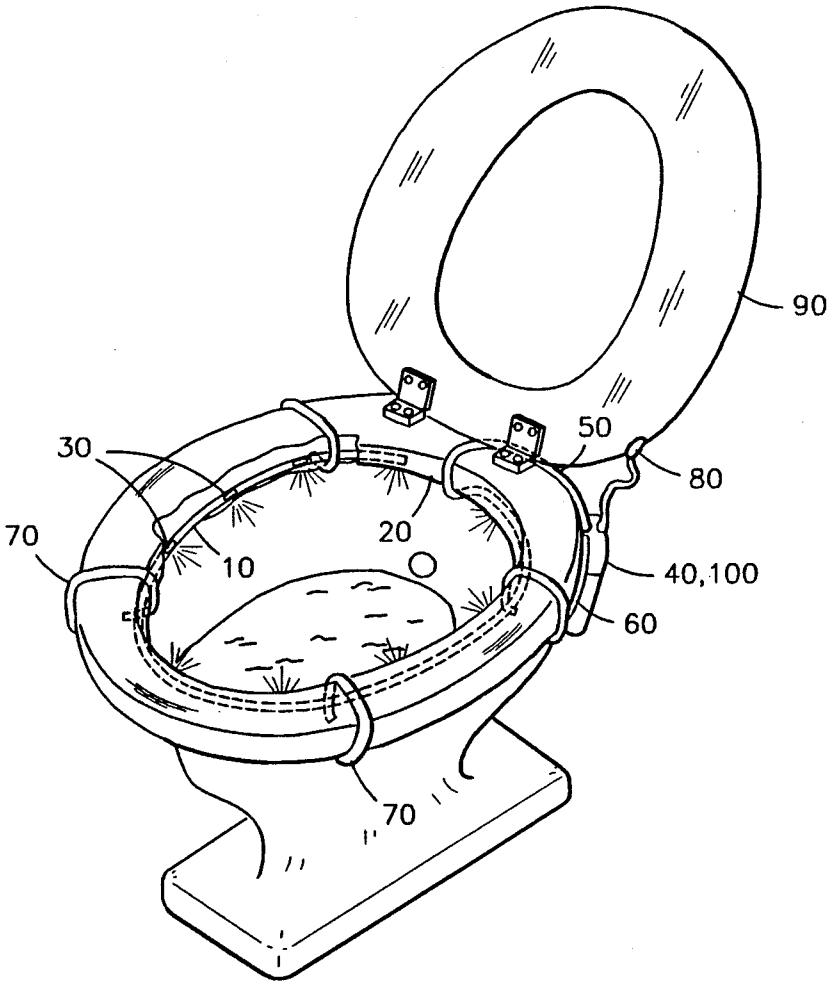
FIG. 1 is a perspective illustration of the invention, illustrating a tube with spaced apart lamps therein held under the rim of a toilet.

FIG. 1 illustrates a night light for a toilet. A flexible, moisture impermeable, transparent tube 10 is positioned under an upper rim 20 of the toilet bowl and extended around the toilet bowl. A plurality of spaced apart electrical lamps 30 are wired for receiving electrical power and lay within the tube 10. A power source 40, such as a battery or other low-voltage DC source, includes a connecting means 50, such as a connector cable, for connecting the power source 40 to the lamps 30. A mounting means 60, such as double-sided adhesive tape, is included for mounting the power source 40 on the external surface of the toilet. A plurality of holding means 70, such as the holding clips of FIG. 1, are positioned in spaced relationship around the toilet rim for removably holding the tube 10 in position under the upper rim 20 of the toilet. Alternatively, the tube 10 may be manufactured from a semi-rigid material such that the tube 10, when positioned under the toil bowl, exerts enough force against the toilet bowl to remain in place. In such an embodiment, holding means 70 are unnecessary.

Figure 2:
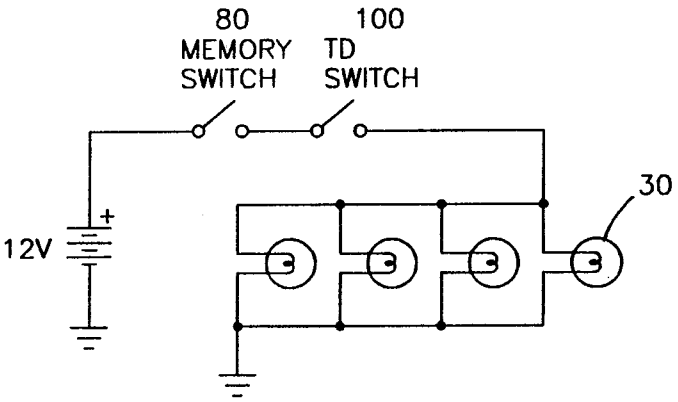
FIG. 2 is a schematic diagram of one embodiment of the invention, illustrating a lamp circuit that may be broken by either a position-sensitive switch or a time-delay switch.

A switch 80 is wired as part of a circuit formed by the switch 80, the lamps 30, and the power source 40 (FIG. 2). Preferably, the switch 80 is position sensitive and may be fixed to a hinged member 90 of the toilet that is capable of assuming a horizontal and a vertical orientation, such as a toilet seat or lid. As such, the switch 80 closes when the hinged member 90 is moved to the vertical orientation, thereby completing the circuit so that the lamps 30 illuminate the interior of the toilet bowl. Clearly, however, the invention is not limited to the manual, mechanical switch 80. For example, a sound actuating switch (not shown) could be used to sense someone entering the bathroom. Likewise, an ultrasonic or other type of motion sensor could be used. Such sensors could be easily mounted on the top of the toilet and wired into the circuit of the present invention by someone skilled in the art.

A time-delay element 100 may be included in the circuit such that when the circuit is energized, the time-delay element 100 breaks the circuit after a selectable set period of time if the switch 80 has remained closed (FIG. 2). Such a time-delay element 100 increases the life of the power source 40 in the event that the switch 80 is left closed, that is, if the hinged member 90 is inadvertently left in the vertical position.

Figure 3:
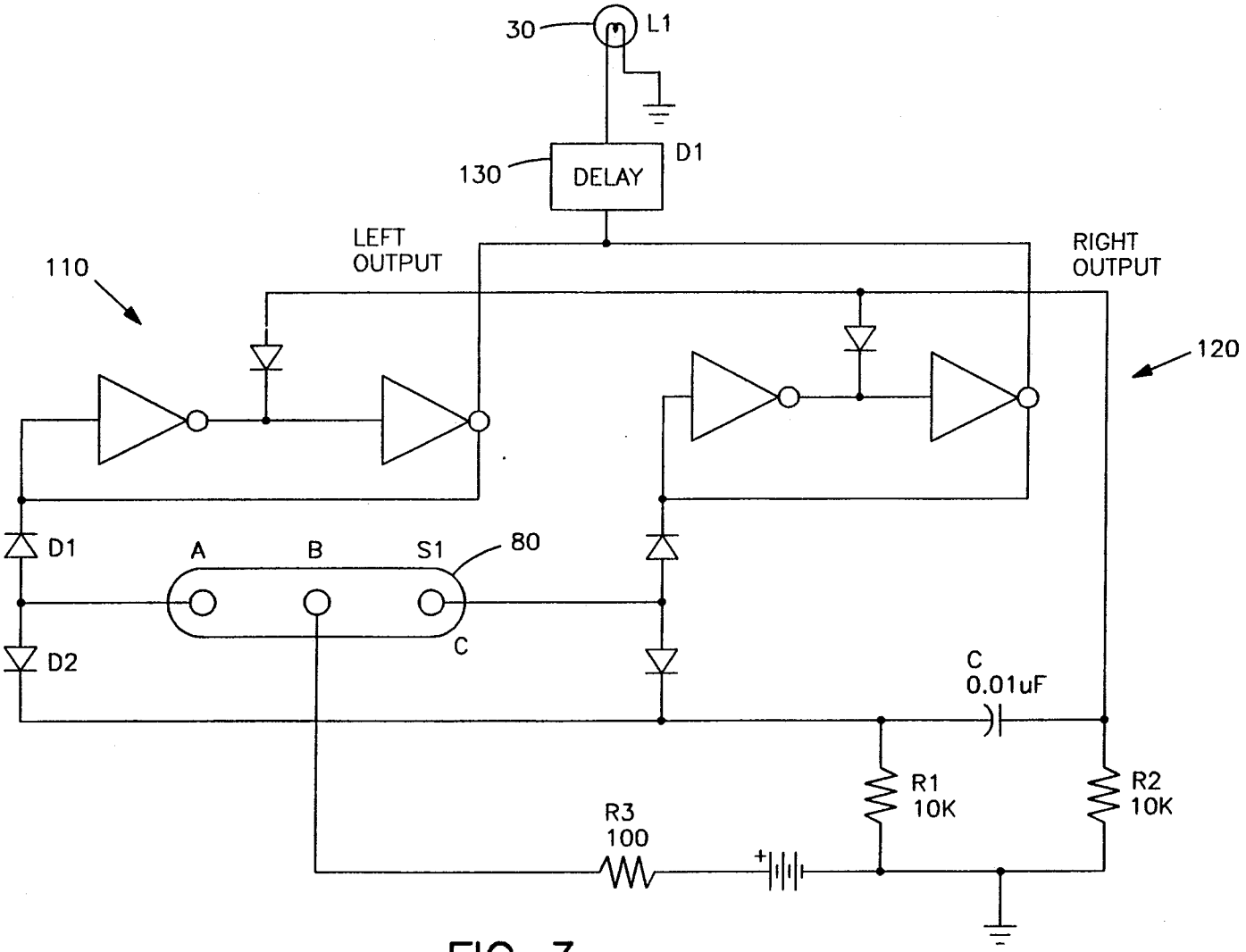
FIG. 3 is a schematic diagram of the preferred embodiment of the invention, illustrating a lamp circuit that may be energized by changing the state of the position-sensitive switch.

In the preferred embodiment of the invention, illustrated in FIG. 3, the lamps 30 are switched to the "on" state whenever the hinged member 90 changes position. After being "on" for a pre-set period of time, the lamps 30 are set to the "off" state, until the hinged member 90 position is changed once again. A first energizing means 110 and a second energizing means 120 are included, each of which may energize the lamps 30 by completing the circuit. The first energizing means 110 is actuated by lifting the hinged member 90 into a vertical position, while the second energizing means 120 is actuated by positioning the hinged member 90 in a horizontal position. A delayed deenergizing means 130 is further included that deenergizes the lamp 30 by breaking the circuit after a pre-set delay time. As such, to switch on the lamps 30 for the pre-set delay time, one simply changes the position of the hinged member 90.

In use, the tube 10 is installed with the holding means 70 under the rim and the power source 40 is mounted with the mounting means 60 to an external surface of the toilet. The connecting means 50 is connected between the tube 10 and the power source 40, and the switch 80 is mounted to the hinged member 90, such as with double-sided tape or the like. To energize the lamps 30 in one embodiment of the invention, the hinged member 90 is moved to a vertical orientation. To deenergize the lamps 30, the hinged member 90 is moved to a horizontal orientation, or, with the time-delay element 100 included in the circuit, the hinged member 90 is left in the vertical orientation and the time-delay element 100 breaks the circuit after the set period of time.

To energize the lamps in the preferred embodiment of the invention, the hinged member 90 is moved from either the vertical orientation to the horizontal orientation, or from the horizontal orientation to the vertical orientation, thereby causing either the first energizing means 110 or the second energizing means 120 to energize the lamps 30, respectively. Then, after the pre-set delay time, the delayed deenergizing means 130 breaks the circuit and deenergizes the lamps 30.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A night light for a toilet having a bowl with an upper rim extending therearound, the night light comprising:
   - a flexible, moisture impermeable transparent tube adapted to be positioned under the upper rim of the toilet bowl, and to extend around the toilet bowl;
   - a plurality of spaced apart electrical lamps wired for receiving electrical power, the lamps laying within the tube;
   - a power source including means for connecting the power source to the lamps and means for mounting the power source on an external surface of the toilet;
   - a plurality of holding means adapted to be positioned in spaced relationship around the toilet rim for holding the tube in position under the rim; and
   - a switch wired as part of a circuit formed by the switch, the lamps and the power source, the switch capable of closing the circuit so that the lamps illuminate the interior of the toilet bowl.

2. The light of claim 1 wherein the switch is position sensitive, the toilet including a member hinged to the bowl and capable of assuming a horizontal and a vertical orientation, the switch being adapted to be fixed to the hinged member so that when the hinged element is moved to the vertical orientation, the switch closes thereby completing the circuit so that the lamps are energized.

3. The light of claim 1 wherein the circuit includes a time-delay element so that when the circuit is energized, the time-delay element breaks the circuit after a selectable set period of time.

4. The light of claim 1 wherein the switch is position sensitive, the toilet including a member hinged to the bowl and capable of assuming a horizontal and a vertical orientation, the switch being adapted to be fixed to the hinged member so that when the hinged member is moved to the vertical orientation from the horizontal orientation, or to the horizontal orientation form the vertical orientation, the switch closes thereby completing the circuit so that the lamps are energized.

5. The light of claim 4 wherein the circuit includes a time-delay element so that when the circuit is energized, the time-delay element breaks the circuit after a selectable set period of time.

6. The light of claim 1 wherein the circuit includes first and second means for energizing of the lamps, and first and second means for delayed deenergizing of the lamps.

* * * * *